US010627051B2

(12) United States Patent
Lamiable et al.

(10) Patent No.: US 10,627,051 B2
(45) Date of Patent: Apr. 21, 2020

(54) TAP ASSEMBLY WITH COVER AND ELECTRONIC STATUS INDICATOR

(71) Applicant: Luxembourg Patent Company S.A., Lintgen (LU)

(72) Inventors: Morgan Lamiable, Metzervisse (FR); Jean-Claude Schmitz, Heisdorf (LU)

(73) Assignee: LUXEMBOURG PATENT COMPANY S.A., Luxembourg (LU)

( * ) Notice: Subject to any disclaimer, the term of this patent is extended or adjusted under 35 U.S.C. 154(b) by 0 days.

(21) Appl. No.: 15/776,707

(22) PCT Filed: Nov. 14, 2016

(86) PCT No.: PCT/EP2016/077568
§ 371 (c)(1),
(2) Date: May 16, 2018

(87) PCT Pub. No.: WO2017/085009
PCT Pub. Date: May 26, 2017

(65) Prior Publication Data

US 2018/0347760 A1 Dec. 6, 2018

(30) Foreign Application Priority Data

Nov. 16, 2015 (LU) ..... 92874

(51) Int. Cl.
*F17C 13/04* (2006.01)
*F17C 13/02* (2006.01)

(52) U.S. Cl.
CPC ..... *F17C 13/04* (2013.01); *F17C 13/025* (2013.01); *F17C 2201/058* (2013.01);
(Continued)

(58) Field of Classification Search
CPC .... F17C 13/04; F17C 13/025; F17C 2265/04; F17C 2205/0338; F17C 2205/0329;
(Continued)

(56) References Cited

U.S. PATENT DOCUMENTS 4,575,262 A * 3/1986 Andersen ..... G01K 1/028 136/291
4,968,152 A * 11/1990 Bergmann ..... F16K 11/0787 137/551

(Continued)

FOREIGN PATENT DOCUMENTS

EP 2339222 A2 6/2011
EP 2918892 A1 9/2015

(Continued)

OTHER PUBLICATIONS

International Search Report for corresponding PCT/EP2016/077568 dated Jan. 1, 2017.

*Primary Examiner* — Jessica Cahill
*Assistant Examiner* — Patrick C Williams
(74) *Attorney, Agent, or Firm* — Sandberg Phoenix & von Gontard PC

(57) ABSTRACT

A tap for gas cylinder, comprising a body with an inlet, an outlet and a passage connecting the inlet with the outlet; an electronic indicator of the status of the tap and/or cylinder, the indicator being mounted on the body; a pressure sensor electrically connected to the electronic indicator and providing to the indicator the gas pressure at the inlet. The pressure sensor is mounted on the body at a location that is distinct from the mounting location of the electronic indicator. The invention is also directed to a tap assembly comprising the above tap and a cover housing the tap.

15 Claims, 2 Drawing Sheets

(52) U.S. Cl.
CPC ..... *F17C 2205/0165* (2013.01); *F17C 2205/0308* (2013.01); *F17C 2205/0323* (2013.01); *F17C 2205/0329* (2013.01); *F17C 2205/0338* (2013.01); *F17C 2223/0123* (2013.01); *F17C 2223/035* (2013.01); *F17C 2250/043* (2013.01); *F17C 2250/0626* (2013.01); *F17C 2250/0636* (2013.01); *F17C 2265/04* (2013.01); *F17C 2270/02* (2013.01); *F17C 2270/0745* (2013.01)

(58) Field of Classification Search
CPC ..... F17C 2205/0323; F17C 2205/0308; F17C 2205/0165; F17C 2270/0745; F17C 2270/02; F17C 2250/0636; F17C 2250/0626; F17C 2250/043; F17C 2223/035; F17C 2223/0123; F17C 2201/058; F16K 37/005; Y10T 137/8242; Y10T 137/8275
See application file for complete search history.

(56) References Cited

U.S. PATENT DOCUMENTS 5,320,137 A * 6/1994 Huang ..... F16K 37/005 137/551
6,137,417 A * 10/2000 McDermott ..... G01L 19/12 128/202.22
6,182,692 B1 * 2/2001 Fischer ..... F16K 1/305 116/266
7,114,510 B2 * 10/2006 Peters ..... F16K 31/60 137/1
2006/0102236 A1 * 5/2006 Phillips ..... F16K 37/0008 137/557
2009/0014073 A1 * 1/2009 Huang ..... G05D 16/0669 137/540
2011/0309076 A1 * 12/2011 Liebenberg ..... F17C 13/025 220/203.01
2013/0037363 A1 * 2/2013 Palmer ..... G01G 19/58 190/115
2014/0130875 A1 5/2014 Fowler et al.
2015/0027361 A1 * 1/2015 Eyring ..... G01L 19/10 116/201
2015/0260343 A1 * 9/2015 Baune ..... F17C 1/00 206/0.6
2015/0260346 A1 * 9/2015 Ligonesche ..... F17C 1/00 206/0.6

FOREIGN PATENT DOCUMENTS

WO 2014074313 A1 5/2014
WO 2015132092 A2 9/2015

* cited by examiner

TAP ASSEMBLY WITH COVER AND ELECTRONIC STATUS INDICATOR

CROSS-REFERENCE TO RELATED APPLICATIONS

The present invention is the US national stage under 35 U.S.C. § 371 of International Application No. PCT/EP2016/077568, which was filed on Nov. 14, 2016, and which claims the priority of application LU 92874 filed on Nov. 16, 2015, the content of which (text, drawings and claims) are incorporated here by reference in its entirety.

FIELD

The invention is directed to the field of taps for gas cylinders, more particularly to such taps that comprise a status indicator, the status including the pressure in the gas cylinder, the flow-rate and/or the remaining service time.

BACKGROUND

Prior art patent document published WO 2015/132092 A2 discloses a gas cylinder with a tap and a tap cover comprising a shell for housing the tap and a hook pivotally mounted on the shell. The hook is configured for securing the gas cylinder in an upright position to a horizontal bar of a hospital bed. The shell comprises reservations on its external surface configured for receiving the hook in a folded position so as to generally conform to said external surface. The use of a cover with a handle is interesting in that it provides an ergonomic protection for the tap that fulfils additional functions such as providing a handle, providing a convenient rotating flow selector and providing a hook for securing the cylinder to a bar like a bar of a hospital bed. That document is however silent about any indication of the pressure in the gas cylinder and/or the remaining service time.

Prior art patent document published WO 2014/074313 A1 discloses a tap for gas cylinders, that provides a function of indicating the amount of gas left in the cylinder. To that end, the tap comprises a pressure sensor, an electronic display and an electronic control system electrically connected to the pressure sensor and the display. The control system is configured for calculating an operation time that is left until the amount of gas in the cylinder reaches a predetermined low level. This calculated time is displayed with the electronic display. The electronic control system is supplied in electrical energy by a battery. This system is either affixed to the tap or to a protective cap. When affixed to the tap, the system comprises a pressure sensor that is fluidly connected to the tap via the mounting of said system to the tap body. The system comprises also switching means for detecting the angular position of a flow selector located at the top of the tap. The teaching is quite interesting by the functions that the tap can fulfil. The modularity is however limited in that the control system, the pressure sensor and the display are housed in a common housing forming an electronic manometer. Also, the integration of the pressure sensor, the electronic display, the electronic control system and the battery remains however subject to improvements.

SUMMARY

The invention has for technical problem to provide a tap equipped with an electronic status indicator and providing an improved architecture, among others with regard to design freedom, maintenance and assembling operations.

The invention is directed to a tap for gas cylinder, comprising: a body with an inlet, an outlet and a passage connecting the inlet with the outlet; an electronic indicator of the status of the tap and/or cylinder, the indicator being mounted on the body; a pressure sensor electrically connected to the electronic indicator and providing to the indicator the gas pressure at the inlet; wherein the pressure sensor is mounted on the body at a location that is distinct from the mounting location of the electronic indicator.

According to various embodiments, the tap further comprises a device fluidly arranged in the passage and with a hand-wheel for adjusting the outlet pressure and/or flow-rate, the electronic indicator being housed in the hand-wheel. The device can be a pressure-reducer or a flow-selector.

According to various embodiments, the electronic indicator is rigidly fixed with the body.

According to various embodiments, it comprises a shaft rigidly mounted on the body and supporting the electronic indicator.

According to various embodiments, the hand-wheel is rotatably mounted on the shaft.

According to various embodiments, the shaft comprises a longitudinal bore, the tap comprising electrical wires connected to the electronic indicator and extending through the channel.

According to various embodiments, the body comprises a bore forming with the bore of the shaft a continuous channel through which extend the electrical wires.

According to various embodiments, the bore of the body and the electrical wires open out through an external surface of the body, the surface in various instances being a rear side of the tap when the hand-wheel and/or the electrical indicator are on a front side of the tap.

According to various embodiments, the electrical wires connect the electronic indicator to the pressure sensor.

According to various embodiments, the shaft extends generally upwardly from the body, when the tap is in a mounting position on the gas cylinder in any upright position, forming an angle with a longitudinal axis of the tap that is comprised between 30° and 60°.

According to various embodiments, the pressure sensor is mounted on an upper portion of the body when the tap is in a mounting position on the gas cylinder in an upright position.

The invention is also directed to a tap assembly comprising: a tap for gas cylinder; and a cover housing the tap; wherein the tap is in accordance with the invention.

According to various embodiments, the assembly comprises at least one battery housed in the cover and electrically connected to the pressure sensor and/or the electronic indicator.

According to various embodiments, the cover comprises a shell, that is in various instances generally ball-shaped, and a handle, the at least one battery being housed in the handle. The shell can comprise an upper half-shell and a lower half-shell, the half-shells being joined to each other. The handle can be fixed with the shell by at least one arm, in various instances by two arms.

According to various embodiments, the cover comprises a removable rear cover providing access to the electrical connection of the electronic indicator, the pressure sensor and/or the at least one battery.

The invention is particularly interesting in that it provides more flexibility for the pressure sensor. This latter can be built larger and be easily mounted and dismounted, e.g. for maintenance purposes. In case of failure of the pressure sensor, this latter can be easily dismounted without having to dismount the hand-wheel and the electronic indicator. The wires are also protected in the channel extending through the shaft and the body through which they are laid. In addition, the wires run essentially at the rear side of the tap, thereby avoiding any interference at the front with the hand-wheel 12 and the outlet connector 14 which the user manipulates.

DRAWINGS

DESCRIPTION

Figure 1:
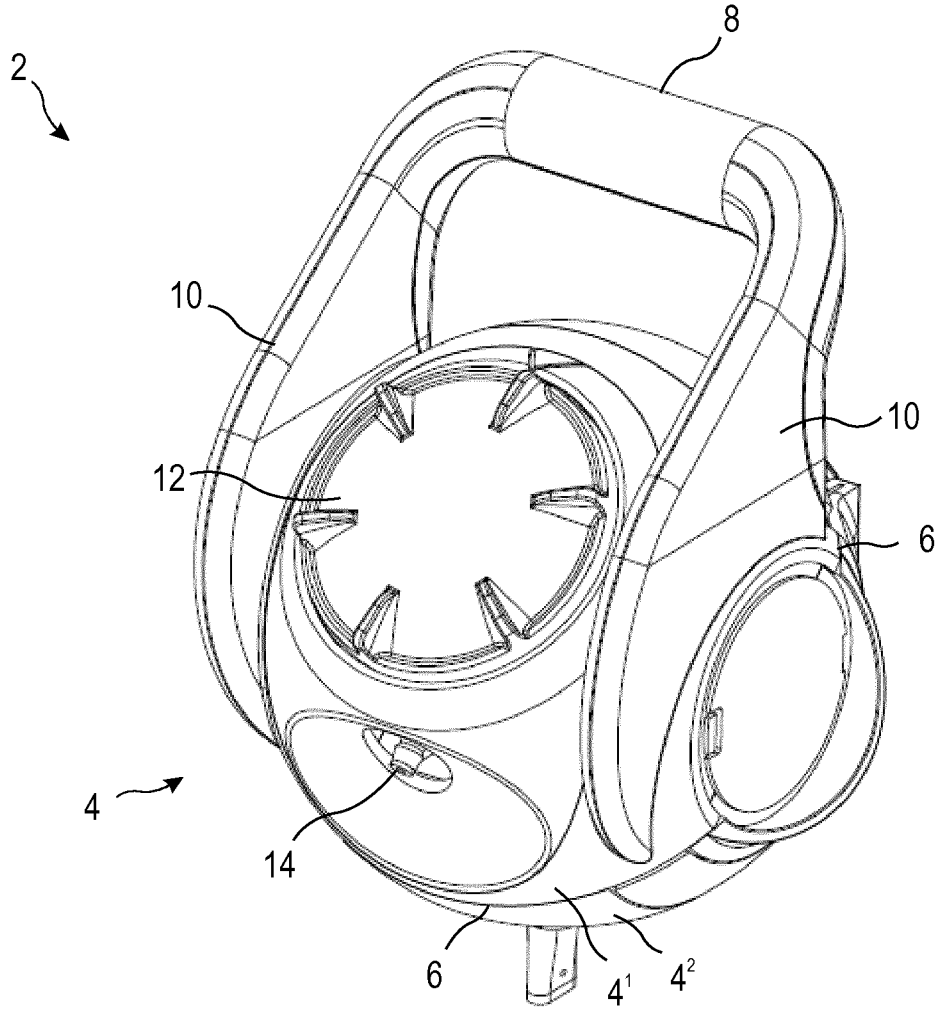
FIG. 1 is a perspective view of a tap assembly in accordance with various embodiments of the invention.

FIG. 1 illustrates in perspective a tap assembly in accordance with various embodiments of the invention. The tap assembly 2 comprises, essentially, a tap (not visible in FIG. 1) and a cover 4 housing the tap.

The cover 4 comprises a shell that is advantageously generally ball-shaped. That shell can comprise an upper half-shell $\mathbf{4}^1$ and a lower half-shell $\mathbf{4}^2$ that are joined to each other via a contact plane 6 that is generally inclined relative to both vertical and horizontal directions. That inclination is of about 45° relative to the vertical direction and also to the horizontal one. The inclination is oriented so that the contact plane 6 rises from the front to the rear of the assembly.

The cover 4 can also comprise a handle 8 provided above the shell $\mathbf{4}^1$, $\mathbf{4}^2$. The handle 8 can extend transversally and generally horizontally. It can be unitary with the upper half-shell $\mathbf{4}^1$ via the laterals arms 10.

The tap assembly 2 comprises also a hand-wheel 12 for adjusting the flow-rate and/or the outlet pressure of the tap. The tap can comprise a shut-off valve, a pressure reducer and/or a flow-selector, the hand-wheel being configured for operating at least one of the shut-off valve, pressure reducer and flow-selector. The construction of the tap will be described with more details in relation with FIG. 2.

As is apparent in FIG. 1, the hand-wheel 12 is housed in an opening of the shell, for instance the upper half-shell $\mathbf{4}^1$. The hand-wheel 12 comprises an outer surface that is generally curved to be flush with the surrounding outer surface of the shell. Also the outer surface of the hand-wheel 12 can complement the generally ball-shaped outer surface of the shell. The hand-wheel 12 is advantageously positioned at a front and upper area of the shell $\mathbf{4}^1$ in order to be most visible and ergonomically accessible to a user.

An outlet connector 14 of the tap is positioned below the hand-wheel 12. It extends through an opening at a lower front area of the upper half-shell $\mathbf{4}^1$.

Figure 2:
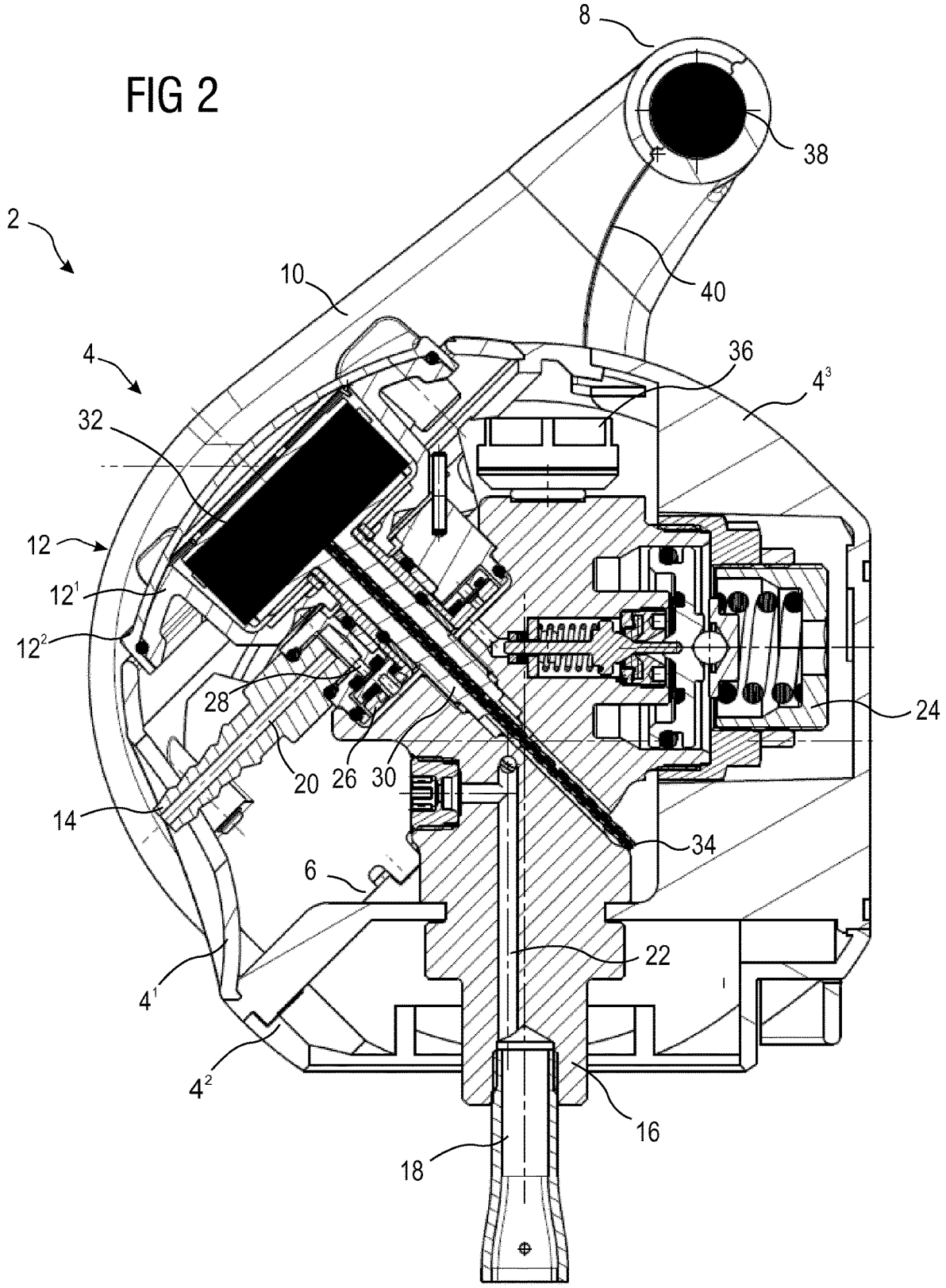
FIG. 2 is a sectional view of the tap assembly of FIG. 1 in accordance with various embodiments of the invention.

FIG. 2 is a sectional view of the tap assembly of FIG. 1. The section is along a vertical longitudinal plane that cuts the assembly into two left and right halves. FIG. 2 is a view of the left halve.

In FIG. 2 the tap is well apparent. It comprises a body 16 with a gas inlet 18, a gas outlet 20 and a gas passage 22 interconnecting the inlet with the outlet. In the present case, the tap comprises a pressure reducer 24, such a pressure reducer being as such well known to the skilled person. The tap comprises also a flow-selector 26 consisting of a disk with calibrated holes, the disk being rotatable so as to present one of the calibrated holes in front of a specific section 28 of the gas passage 22, the section being in direction connection with the outlet 20. Depending on the calibrated hole that is positioned in front of the section 28, the gas flow-rate will be higher or lower. The principle of such a flow-selector is as such well known to the skilled person.

In various embodiments of the present invention, the rotatable disk of the flow-selector is rotatably mounted around a shaft 30 that is rigidly fixed to the body 16. For instance, the shaft 30 comprises at an end a thread that is engaged in a corresponding thread in the body 16.

As apparent in FIG. 2, the longitudinal axis of the shaft 30 forms an angle of about 45°, or at least comprised between 30° and 60°, with the longitudinal vertical axis of the tap. The shaft 30 extends upwardly from the body 16 towards a front area of the assembly.

The hand-wheel 12 forms a cavity housing an electronic indicator 32 of the status of the assembly and/or of the gas cylinder. The hand-wheel can comprise a generally cup-shaped body $\mathbf{12}^1$ and a transparent cover $\mathbf{12}^2$. The hand-wheel 12, for instance the body $\mathbf{12}^1$, is rigidly attached to the rotatable disk of the flow-selector 26, so that the angular position of that disk can be selected via the hand-wheel.

The electronic indicator 32 is supported by the shaft 30 which is rigid with the body 16. This means that the electronic indicator is fixed with the body whereas the hand-wheel 12 surrounding it is rotatable.

The shaft 30 comprises a bore or drill-hole that extends through its whole length. The body 16 comprises also a bore or drill-hole that forms with the bore of the shaft a continuous channel through which electrical wires 34 of the electronic indicator extend. The bore of the body 16 forming that channel opens out at a rear area of the body 16, opposite to the front one where the shaft 30 and the hand-wheel 12 are mounted. The gas passage 22 inside the body is configured so as not to intersect with the channel of the electrical wires 34.

The tap comprises also a pressure sensor 36 mounted directed on the body 16. For instance, the pressure sensor is mounted on an upper area of the body 16, in any case at a location that is distinct from the mounting of the shaft 30 and the hand-wheel 12. The pressure sensor 36, more particularly its mounting on the body 16, is configured for being in fluidic direct communication with the gas passage 22. For instance, the gas passage 22 comprises a section (not visible) that extends behind the section plane of FIG. 2, in the upper portion of the body, interconnecting the lower vertical section (visible in FIG. 2) with the pressure sensor 36.

The electrical wires 34 are electrically connected to the electronic indicator 32 and to the pressure sensor 36. This latter provides indeed a pressure information to the electronic indicator 32. This latter comprises an electronic unit and a display for displaying to a user information about the pressure in the gas cylinder and/or about the remaining operation time. The remaining operation time can be calculated based on the pressure in the cylinder and on the pressure drop in the cylinder due to the gas consumption, more specifically the selected gas flow-rate.

One or several batteries 38 can be housed in the cover 4, more specifically in the handle 8 of the cover 4. Electrical wire(s) in connection with the at least one battery 38 can extend through at least one of the arms 10 supporting the handle 8. These wires 40 can be connected to the pressure sensor 36 and to the electronic indicator 32 for supplying them with electrical energy.

The shell of the cover 4 can also comprise a rear cover $\mathbf{4}^3$ that is removable from the upper and lower half-shells $\mathbf{4}^1$ and $\mathbf{4}^2$. Removal of this cover $\mathbf{4}^3$ provides access to the cavity of the shell and more particularly to the wires 34 and 40. The electrical indicator 32, the pressure sensor 36 and the battery/batteries 38 can then be easily connected together or disconnected from the rear side of the assembly 2.

The invention claimed is:

1. A tap for gas cylinder, said tap comprising:

a body with an inlet, an outlet and a passage connecting the inlet with the outlet;

an electronic indicator of the status of at least one of the tap and cylinder, the indicator being mounted on the body;

a pressure sensor electrically connected to the electronic indicator and structured and operable to provide to the indicator the gas pressure at the inlet;

a shaft rigidly mounted on the body and supporting the electronic indicator;

wherein the shaft comprises a longitudinal bore, the tap comprising electrical wires connected to the electronic indicator and extending through the bore; and wherein the pressure sensor is mounted on the body at a location that is distinct from the mounting location of the electronic indicator.

2. The tap according to claim 1, wherein the tap further comprises a device fluidly arranged in the passage and with a hand-wheel for adjusting at least one of the outlet pressure and the flow-rate, the electronic indicator being housed in the hand-wheel.

3. The tap according to claim 2, wherein the electronic indicator is rigidly fixed with the body.

4. The tap according to claim 2, wherein the hand-wheel is rotatably mounted on the shaft.

5. The tap according to claim 1, wherein the body comprises a bore forming with the bore of the shaft a continuous channel through which extend the electrical wires.

6. The tap according to claim 5, wherein the bore of the body and the electrical wires open out through an external surface of the body.

7. The tap according to claim 5, wherein the bore of the body and the electrical wires open out through an external surface being a rear side of the tap when at least one of the hand-wheel and the electrical indicator are on a front side of the tap.

8. The tap according to claim 1, wherein the electrical wires connect the electronic indicator to the pressure sensor.

9. The tap according to claim 1, wherein the shaft extends generally upwardly from the body, when the tap is in a mounting position on the gas cylinder in any upright position, forming an angle with a longitudinal axis of the tap that is comprised between 30° and 60°.

10. The tap according to claim 1, wherein the pressure sensor is mounted on an upper portion of the body when the tap is in a mounting position on the gas cylinder in an upright position.

11. A tap assembly, said assembly comprising:

a tap for gas cylinder; and a cover housing the tap, wherein the tap comprises:

a body with an inlet, an outlet and a passage connecting the inlet with the outlet;

an electronic indicator of the status of at least one of the tap and the cylinder, the indicator being mounted on the body;

a pressure sensor electrically connected to the electronic indicator and structured and operable to provide to the indicator the gas pressure at the inlet;

a shaft rigidly mounted on the body and supporting the electronic indicator;

wherein the shaft comprises a longitudinal bore, the tap comprising electrical wires connected to the electronic indicator and extending through the bore; and wherein the pressure sensor is mounted on the body at a location that is distinct from the mounting location of the electronic indicator.

12. The tap assembly according to claim 11, further comprising at least one battery housed in the cover and electrically connected to at least one of the pressure sensor and the electronic indicator.

13. The tap assembly according to claim 12, wherein the cover comprises a shell and a handle, the at least one battery being housed in the handle.

14. The tap assembly according to claim 12, wherein the cover comprises a shell that is generally ball-shaped.

15. The tap assembly according to claim 11, wherein the cover comprises a removable rear cover piece providing access to the electrical connection of at least one of the electronic indicator, the pressure sensor and at least one battery.

* * * * *